United States Patent [19]

Henrion

[11] 3,983,935

[45] Oct. 5, 1976

[54] HEAT EXCHANGER

[75] Inventor: Charles Emile Henrion, Nancy, France

[73] Assignee: L'Appareillage Thermique, Essey-les-Nancy, France

[22] Filed: Jan. 16, 1975

[21] Appl. No.: 541,690

[30] Foreign Application Priority Data

Jan. 16, 1974 France ..... 74.01470

[52] U.S. Cl. ..... 165/166

[51] Int. Cl.[2] ..... F28F 3/02

[58] Field of Search ..... 165/130, 131, 155, 165, 165/170, 140; 122/16, 23

[56] References Cited

UNITED STATES PATENTS

| | | | |
|---|---|---|---|
| 1,991,631 | 2/1935 | Sangster | 165/174 |
| 2,064,931 | 12/1936 | Lysholm | 165/166 X |
| 2,258,696 | 10/1941 | Retz et al. | 122/16 |
| 2,600,595 | 6/1952 | Wilson | 165/155 |
| 2,703,225 | 3/1955 | Cooper | 165/155 |

*Primary Examiner*—Charles J. Myhre
*Assistant Examiner*—Theophil W. Streule, Jr.
*Attorney, Agent, or Firm*—Wenderoth, Lind & Ponack

[57] ABSTRACT

The exchanger comprises first passageways for the flow of a first fluid to be heated, such as air, and second passageways between the first passageways for the heating fluid. The lateral walls of the passageways constitute the heat exchange walls and have corrugations which define a plurality of enlarged parts in the passageways.

Baffles are disposed in each of the enlarged parts. Each baffle is constituted by a tube which is disposed transversely of the direction of flow of the fluid and has open end portions which extend through the lateral walls into a neighboring passageway and open onto said neighboring passageway so as to constitute a by-pass for a portion of the fluid flowing in said neighboring passageway.

6 Claims, 6 Drawing Figures

HEAT EXCHANGER

The present invention relates to heat exchangers and more particularly to exchangers employing heat carried along by gases of combustion from industrial furnaces, boilers or the like for the purpose of heating a fluid such as air or gases.

Heat exchangers of the aforementioned types are known which comprise metal box structures placed in side-by-side relation in which the air to be heated flows, the hot gases flowing between the box structures.

Each box structure has corrugated lateral walls defining enlarged parts, a baffle of a generally tubular shape, adapted to create turbulence in the air stream, being disposed in each enlarged part.

The lateral walls of two neighbouring box structures define a space constituted by successive narrowed parts and enlarged parts, tubular baffles, similar to aforementioned baffles, being disposed in the enlarged parts thus defined.

The fluid flowing in the box structures or in the spaces defined between the latter inpinges on the baffles and is returned against the wall of the box structure whereby insulating films, which adhere to the metal walls of the box structures owing to the viscosity of the fluids flowing in the box structures and in the spaces therebetween, are destroyed.

The transmission of heat between the fluids and the walls of the exchanger is thus considerably improved and this enables the surface area of the heat exchange walls to be reduced.

An object of the invention is to provide a heat exchanger whose performance is still further improved with respect to the performances of known exchangers by still further increasing the heat exchange capacity of the heat exchangers.

According to the invention, there is provided a heat exchanger for in particular employing the heat carried along by a first fluid for heating a second fluid such as air, comprising passageways for the flow of the second fluid to be heated separated by passageways for the flow of the first fluid, the lateral walls of said passageways constituting the heat exchange walls of the heat exchanger and having corrugations which define enlarged parts in said passageways, a baffle being disposed in each one of said enlarged parts, wherein each one of the baffles located in a passageway is constituted by a tube disposed transversely of the direction of the flow of the fluid in said passageway and connected at its ends through said lateral walls to a neighbouring passageway so as to constitute a branch connection for a portion of the fluid flowing in said neighbouring passageway.

According to a particular feature of the invention, said baffles have an end for taking off said portion of fluid flowing in said neighbouring passageway and an end for restoring said portion of fluid to the rest of the fluid stream flowing in said neighbouring passageway, said take-off and restoring ends opening into said neighbouring passageway between two successive enlarged parts thereof.

Further features of the invention will be apparent from the ensuing description with reference to the accompanying drawings given solely by way of example and in which.

Figure 1:
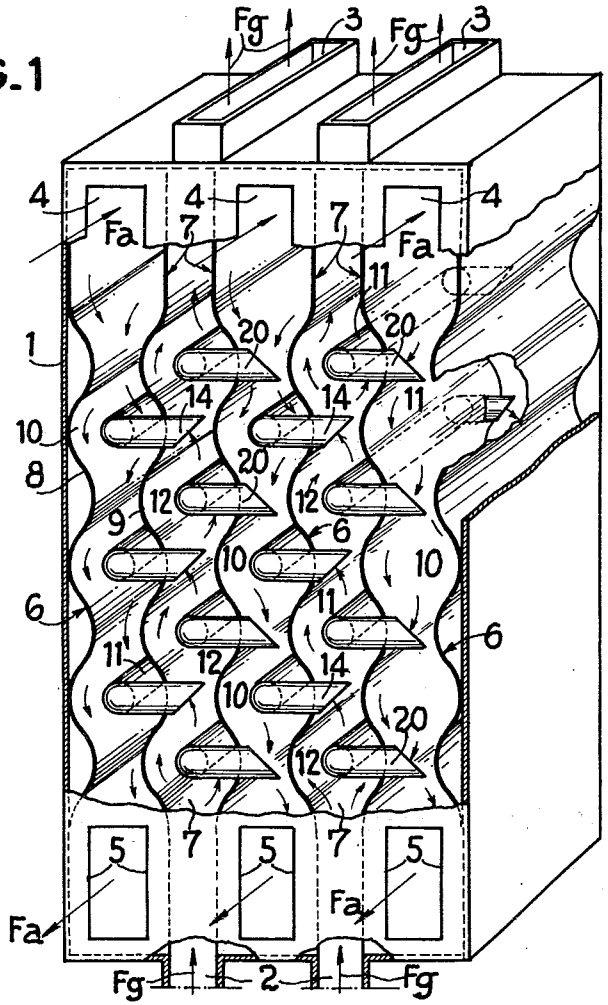
FIG. 1 is a perspective view, with a part cutaway, of a heat exchanger according to the invention.
Figure 2:
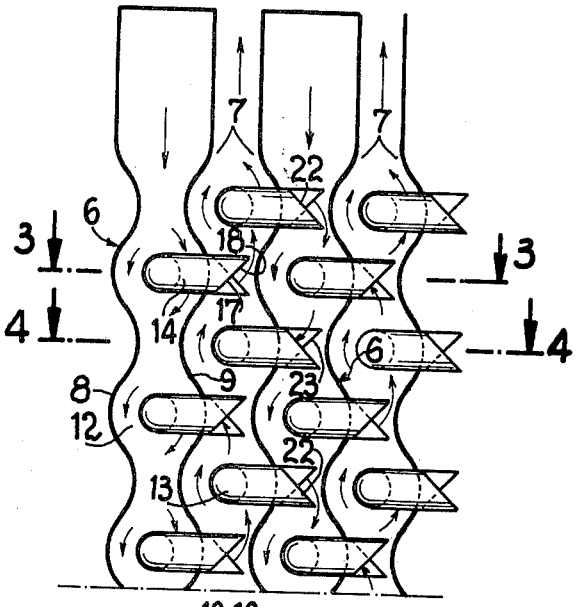
FIG. 2 is a partial diagrammatic elevational view of the heat exchanger shown in FIG. 1.

The heat exchanger shown in FIG. 1 comprises a metal case 1 which is internally heat-insulated and has in its lower wall hot gas inlet pipes 2 for gases coming, for example, from the flue of an industrial furnace (not shown), and in its upper wall outlet pipes 3 for discharging the gases after cooling.

In the front wall of the case 1 there are provided, in the vicinity of the upper wall, pipes 4 for the supply of cold air to be heated and, in the vicinity of the lower wall, outlet pipes 5 for delivering hot air.

Disposed in the case 1 are juxtaposed box structures 6, each box structure being connected to an inlet pipe 4 and to an outlet pipe 5 for the air to be heated. Formed between the box structures 6 are spaces 7 each connected to an inlet pipe 2 and to an outlet pipe 3 for the gases employed in the heat exchanger.

Each box structure 6 has corrugated lateral walls 8 and 9 which define a succession of enlarged parts 10 in each of which is mounted a baffle 11 of tubular shape adapted to create a turbulence in the air flowing in the box structure.

The hollows of the corrugations of the walls 8 and 9 of two neighboring box structures 6 define corresponding enlarged parts 12 in the spaces 7. Tubular baffles 13 having, as concerns the gas flowing in the spaces 7, the same function as the baffles 11 with respect to the air to be heated, are mounted in the enlarged parts 12.

Figure 3:
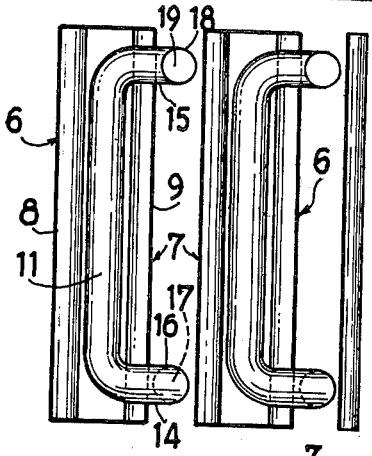
FIG. 3 is a sectional view taken on line 3—3 of FIG. 2.

In order to still further improve the heat exchange capacity of the heat exchanger, the tubular baffles 11 have at their ends horizontal portions 14 and 15 (FIG. 3) which are bent at a right angle and extend through the wall 9 of each box structure 6 and open into the adjacent space 7 adjacent the box structure.

The portion 14 of each baffle 11 has an end 16 which is cut on a bevel so that the orifice 17 thus defined is able to receive a part of the gas flowing in the corresponding space 7, whereas the portion 15 of the baffle has an end 18 also cut on a bevel but with an opposite inclination so that the gas flowing in the space 7 cannot enter the orifice 19 defined by the end 18.

Figure 4:
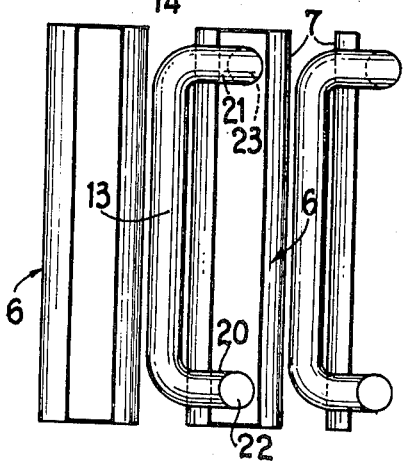
FIG. 4 is a sectional view taken on line 4—4 of FIG. 2.

As can be seen in FIG. 4, the baffles 13 mounted in the enlarged parts 12 of the spaces 7 defined between two neighbouring box structures 6 have horizontal portions 20 and 21 which are bent at a right angle and extend through the walls 8 of the box structures 6.

The portions 20 and 21 have ends 22 and 23 disposed between two consecutive enlarged parts 10 in the stream of air flowing in the box structure.

The ends 22 and 23 are cut on a bevel so as to enable a part of the air flowing in the box structure to pas through the baffle 13.

In the illustrated embodiment, the air to be heated and the hot gases flow in opposite directions. Consequently, the ends 22 and 23 of the baffles have respectively inclinations which are opposed to those of the ends 16 and 18 of the baffles 11.

Figure 5:
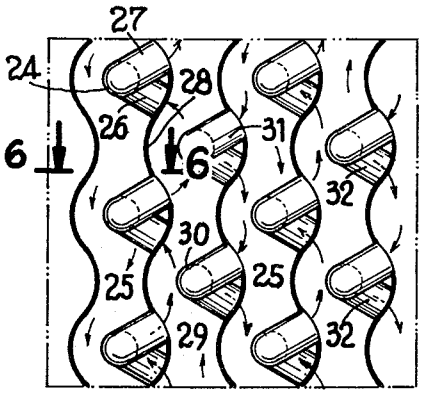
FIG. 5 is a partial diagrammatic view of a modification of a heat exchanger according to the invention.
Figure 6:
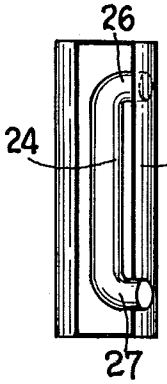
FIG. 6 is a sectional view taken on line 6—6 of FIG. 5.

FIGS. 5 and 6 show a modification of the heat exchanger according to the invention.

The design of this heat exchanger is similar to that of the heat exchanger described with reference to FIGS. 1 to 4 except that the baffles 24 mounted inside the box structure 25 in which the air to be heated flows have portions 26 and 27 which are bent at a right angle and are oblique and connected to the corrugated walls 28 adjacent to the spaces 29 in which the hot gas flows on each side of narrowed parts defined by said walls and in portions of the latter which are inclined with respect to the direction of flow of the gases.

Likewise, baffles 30 disposed in the spaces 29 have portions 31, 32 which are bent at a right angle and are oblique and connected on each side of narrowed parts defined by the corrugated walls of the box structure 25.

The heat exchanger shown in FIGS. 1 to 4 operates in the following manner:

The air to be heated and the hot gases flow in the directions indicated by arrows $F_a$, $F_g$ respectively. These flows are produced by fans (not shown).

The cold air enters the exchanger by way of the pipes 4 and the hot gases from the flue of a furnace enter by way of the pipes 2. The aforementioned fluids flow in the box structures 6 and spaces 7 respectively, the heat exchange occurring through the corrugated walls of the box structures and the baffles 11 and 13 which create the turbulence necessary for the destruction of the films of air and gas which form on each side of the walls of the box structures owing to the viscosity of these fluids.

When the air flowing in one of the box structures reaches the level of an end 22 of a baffle 13, a part of the air enters this end of the baffle and flows in the latter and thereafter issues therefrom at its other end 23 and rejoins the air flowing in the box structure 6.

Owing to the fact that the baffle 13 is placed directly in the stream of hot gas, the air which flows in the baffle undergoes a greater heating than the air which continues to flow in the box structure and consequently ensures a more rapid heating of the whole of the air. This operation is repeated in respect of each baffle encountered by the air stream.

In the same way, when the hot gases flowing in a space 7 encounter a baffle 11, a part of the gases is taken off by the baffle by entering the end 16 and issuing from the baffle at its end 18 and joins the rest of the gaseous stream after having given up the major part of its heat to the air stream in which the baffle 11 is disposed.

Consequently, the heat exchange capacity of the exchanger is considerably increased.

The heat exchanger shown in FIG. 5 operates in a manner similar to that of the exchanger shown in FIGS. 1 to 4.

A part of the air to be heated flowing in a box structure 25 enters a baffle 30 disposed in the neighbouring space 29 in which the hot gases flow by way of the end 31 of the baffle and issues therefrom at the end 32 after having been considerably heated.

The slight difference of pressure on each side of a narrowed part enables a part of the air to be taken off by the baffle.

It will be understood that a similar phenomenon occurs in respect of the gases which flow in the spaces 29 and encounter the orifices of the baffles 24 disposed in the box structure 25.

At the outlet of the heat exchanger, the hot air is delivered by the pipes 5 and the cold gases are discharged by the pipes 3.

In the embodiment just described, the gases and the air flow in opposite directions, but it will be understood that the exchanger according to the invention can be made to operate with the air to be heated and hot gases flowing in the same direction.

The heat exchanger shown in FIG. 1 has three box structures 6, but it will be understood that exchangers of this type may be constructed with a different number of box structures, depending on the available hot gases and on the volume of air to be heated.

Having now described my invention what I claim as new and desire to secure by Letters Patent is:

1. A heat exchanger for in particular employing heat carried along by a first fluid for heating a second fluid such as air, comprising lateral wall means defining first passageways for the flow of the second fluid and second passageways for the flow of the first fluid, the first passageways being separated by the second passageways, the lateral wall means of said passageways constituting the heat exchange walls of the exchanger and having corrugations which define a plurality of enlarged parts in said passageways, and a baffle disposed in each of said enlarged parts, each one of the baffles located in a passageway being constituted by a tube which is disposed transversely of the direction of the flow of the fluid in said passageway and has open end portions which extend through said lateral wall means into a neighbouring passageway and open onto said neighbouring passageway so as to constitute a by-pass for a portion of the fluid flowing in said neighbouring passageway.

2. A heat exchanger as claimed in claim 1, wherein each of said baffles has a take off end for taking off said portion of fluid flowing in said neighbouring passageway and an end for restoring said portion said portion of fluid to the rest of the stream of fluid flowing in said neighbouring passageway, said take off and restoring ends opening into said neighbouring passageway between two successive enlarged parts of said neighbouring passageway.

3. A heat exchanger as claimed in claim 1, wherein each of said baffles has a take off end for taking off said portion of fluid flowing in said neighbouring passageway and an end for restoring said portion of fluid to the rest of the stream of fluid flowing in said neighbouring passageway, a first of said end portions of each baffle is constituted by a horizontal bent portion of the baffle having its end terminating on a bevel and defining said take-off end for facing the stream of fluid flowing in said neighbouring passageway, and the other of said end portions of the baffle is constituted by a horizontal bent portion of the baffle having its end terminating on a bevel with an inclination opposite to that of said first end portion and defining said restoring end.

4. A heat exchanger as claimed in claim 1, wherein each of said baffles has a take off end for taking off said portion of fluid flowing in said neighbouring passageway and an end for restoring said portion of fluid to the rest of the stream of fluid flowing in said neighbouring passageway, the take-off end of each baffle is defined by an oblique bent first portion of the baffle and the restoring end of the baffle is defined by an oblique bent second portion of the baffle, said oblique portions being connected to said neighbouring passageway between two consecutive enlarged parts of the neighbouring passageway in inclined portions of said wall means.

5. A heat exchanger as claimed in claim 1, wherein said passageways in which said second fluid flows are constituted by box structures having corrugated lateral wall means which constitute said heat exchange and separating wall means between the passageways, said passageways in which said first fluid flows being constituted by spaces provided between said box structures.

6. A heat exchanger as claimed in claim 5, comprising a case in which case said box structures are mounted, inlet and outlet pipes for said second fluid connected to said box structures and inlet and outlet pipes for said first fluid connected to said spaces between said box structures.

* * * * *